US009132937B2

(12) United States Patent
Ritzberger

(10) Patent No.: US 9,132,937 B2
(45) Date of Patent: Sep. 15, 2015

(54) PALLET ATTACHMENT FRAME

(71) Applicant: GEORG UTZ HOLDING AG, Bremgarten (CH)

(72) Inventor: Axel Ritzberger, Altendorf (CH)

(73) Assignee: GEORG UTZ HOLDING AG., Bremgarten (CH)

( * ) Notice: Subject to any disclaimer, the term of this patent is extended or adjusted under 35 U.S.C. 154(b) by 0 days.

(21) Appl. No.: 14/016,617

(22) Filed: Sep. 3, 2013

(65) Prior Publication Data

US 2014/0001082 A1 Jan. 2, 2014

(51) Int. Cl.

*B65D 19/38* (2006.01)
*B65D 19/18* (2006.01)
*B65D 25/04* (2006.01)

(Continued)

(52) U.S. Cl.

CPC ..... *B65D 19/38* (2013.01); *B65D 19/0038* (2013.01); *B65D 19/18* (2013.01); *B65D 21/083* (2013.01); *B65D 25/04* (2013.01); *B65D 2519/00034* (2013.01); *B65D 2519/00069* (2013.01); *B65D 2519/0081* (2013.01); *B65D 2519/00174* (2013.01); *B65D 2519/00333* (2013.01); *B65D 2519/00407* (2013.01); *B65D 2519/00412* (2013.01); *B65D 2519/00422* (2013.01); *B65D 2519/00502* (2013.01); *B65D 2519/00611* (2013.01); *B65D 2519/00621* (2013.01); *B65D 2519/00641* (2013.01); *B65D 2519/00875* (2013.01); *B65D 2519/00975* (2013.01); *B65D 2519/00995* (2013.01)

(58) Field of Classification Search

CPC ..... B65D 7/28; B65D 7/30; B65D 11/1833; B65D 2519/0273; B65D 2519/0293; B65D 19/0038; B65D 19/18; B65D 19/38; B65D 21/083; B65D 25/04; B65D 2519/00034; B65D 2519/00069; B65D 2519/00174; B65D 2519/00333; B65D 2519/00407; B65D 2519/00412; B65D 2519/00422; B65D 2519/00502; B65D 2519/00611; B65D 2519/00621; B65D 2519/00641; B65D 2519/0081; B65D 2519/00875; B65D 2519/00975; B65D 2519/00995

USPC ..... 206/600; 220/4.28, 6, 7, 666

See application file for complete search history.

(56) References Cited

U.S. PATENT DOCUMENTS 3,618,805 A * 11/1971 Meller ..... 220/6
5,289,935 A 3/1994 Hillis et al.

(Continued)

FOREIGN PATENT DOCUMENTS

DE 195 02 533 A1 6/1995
DE 10 2004 012198 A1 9/2005

(Continued)

*Primary Examiner* — Bryon Gehman

(74) *Attorney, Agent, or Firm* — Roberts IP Law; John Roberts

(57) ABSTRACT

The invention relates to an attachment frame (2) for transport pallets, comprising receiving elements that are provided on the bottom side of the transport pallet and cooperate with corresponding engaging elements in the upper side of the transport pallet. The attachment frame is composed of a rigid base frame (3) and lateral walls (5) foldably hinged thereon, wherein two opposing lateral walls are designed so that they can be folded down against the pallet surface and the two other opposing lateral walls are designed so that they can be folded down onto the previously folded-down lateral walls. Engaging elements (8) are provided in the upper edges of the lateral walls for corresponding receiving elements in the base frame lower edges.

6 Claims, 9 Drawing Sheets

(51) Int. Cl.
*B65D 19/00* (2006.01)
*B65D 21/08* (2006.01)

(56) References Cited

U.S. PATENT DOCUMENTS

| | | | | |
|---|---|---|---|---|
| 5,788,103 | A * | 8/1998 | Wagner et al. | 220/6 |
| 6,015,056 | A * | 1/2000 | Overholt et al. | 220/6 |
| 6,098,827 | A * | 8/2000 | Overholt et al. | 220/6 |
| 6,290,081 | B1 * | 9/2001 | Merey | 220/7 |
| 6,398,054 | B1 * | 6/2002 | Overholt et al. | 220/7 |
| 6,520,364 | B2 * | 2/2003 | Spykerman et al. | 220/6 |
| 6,776,300 | B2 * | 8/2004 | Walsh et al. | 220/6 |
| 7,264,122 | B2 * | 9/2007 | Koefelda et al. | 206/600 |
| 7,484,634 | B2 * | 2/2009 | Apps | 220/7 |
| 8,056,727 | B1 * | 11/2011 | Marsh | 206/600 |
| 8,434,618 | B2 * | 5/2013 | Mitchell et al. | 220/7 |
| 8,596,459 | B2 * | 12/2013 | Huizingh et al. | 206/600 |
| 9,033,183 | B2 * | 5/2015 | Hug | 220/6 |
| 2008/0296308 | A1 | 12/2008 | Barbalho et al. | |

FOREIGN PATENT DOCUMENTS

| | | | |
|---|---|---|---|
| EP | 1 264 774 | A1 | 12/2002 |
| EP | 1 975 077 | A1 | 10/2008 |
| EP | 2062829 | A1 * | 5/2009 |

* cited by examiner

PALLET ATTACHMENT FRAME

The invention relates to an attachment frame for transport pallets, comprising receiving elements that are provided on the bottom side of the attachment frame and cooperate with corresponding engaging elements in the upper side of the transport pallet.

It is the object of the invention to assemble pallets, for example Euro pallets, into arbitrarily high containers by attaching the attachment frames.

A container thus constructed is to be reduced to minimal volume after emptying.

The invention achieves this object in that the attachment frame is composed of a rigid base frame and lateral walls foldably hinged thereon, wherein two opposing lateral walls are designed so that they can be folded down against the pallet surface and the two other opposing lateral walls are designed so that they can be folded down onto the previously folded-down lateral walls.

The receiving elements on the bottom side of the attachment frame and the engaging elements in the upper side of the transport pallet, or on the upper edge of the foldable lateral walls of the attachment frame, are designed so that form-fit centering takes place during attachment.

Whether the receiving elements or the engaging elements are provided on the pallet or on the attachment frame need not be established.

In this way, a first attachment frame is attached to the pallet, wherein the lowermost attachment frame is screwed onto the transport pallet.

The lateral walls of the attachment frame are moved into the vertical positions thereof, wherein the lateral walls can be fastened to each other by way of locking bars.

A further attachment frame having an identical design is attached to this first attachment frame, wherein the receiving elements in the bottom side of the base frame are brought into engagement with the engaging elements on the upper edge of the lateral walls of the lower attachment frame.

This is repeated until the desired height for the container to be formed has been reached.

Connecting elements are provided for connecting two attachment frames that are placed on top of each other, wherein the connecting elements can, for example, be locking bars that may be displaced in mutually aligned grooves in the lateral walls or the base frame.

After the one attachment frame has been attached to the other, the locking bars are displaced in the mutually aligned grooves so that the two attachment frames are fixed against one another.

Partitions can be inserted into the attached attachment frames. These are used to divide the usable space in keeping with the load, wherein any arbitrary arrangement of the partitions is possible.

Even-numbered multiples of transport pallets comprising accordingly dimensioned attachment frames can be attached next to each other on a base transport pallet.

This means that two appropriately dimensioned attachment frames are attached to a regular Euro pallet, for example, with the overall area of these two frames corresponding to the area of the base pallet.

It is further possible, for example, to position four appropriately dimensioned attachment frames on the base pallet, wherein the sum of the four attachment frame areas is identical to the area of the base pallet.

Further arrangements are possible, such as an attachment frame that takes up only half of the base pallet, while two other appropriately dimensioned attachment frames cover the other half of the base pallet.

The attachment frames are designed so that a further transport pallet can be attached to the upper edges of the foldable lateral walls of an attachment frame, so that so-called mixed stacking is possible.

To this end, pallets may also be provided, the dimensions of which correspond to the attachment frame having smaller dimensions. However, it is also possible to attach a "base pallet" to an attachment frame arrangement.

The invention is illustrated, and will be described in greater detail hereafter based on drawings.

Figure 1:
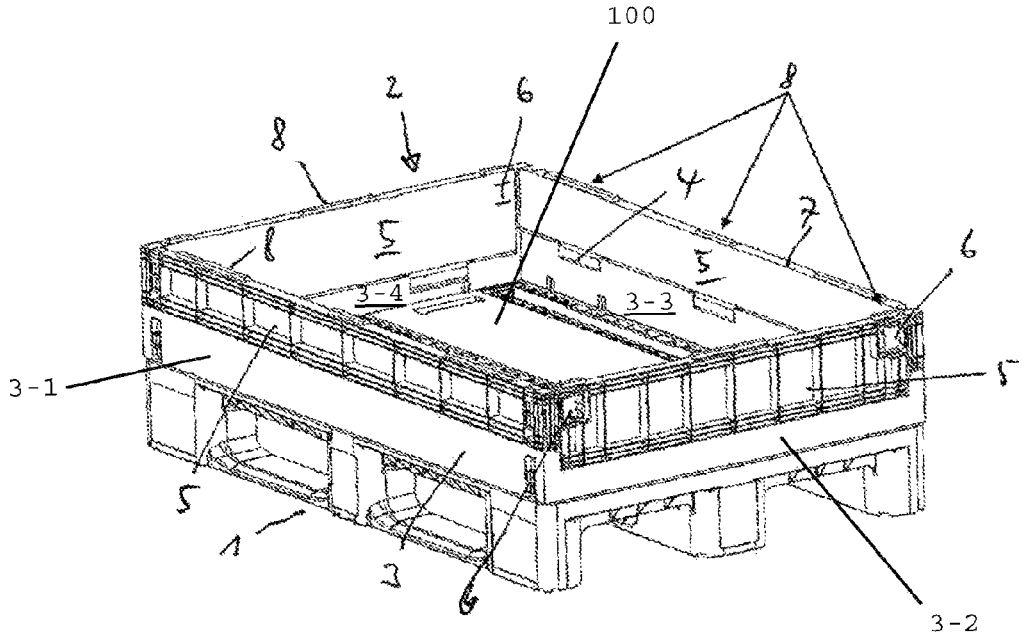
FIG. 1 shows a pallet having an attached attachment frame that is set upright.

FIG. 1 is a perspective illustration of a pallet, denoted by reference numeral 1, having an upper surface 100, to the perimeter 101 of which an attachment frame 2 is attached. The attachment frame 2 is composed of a base frame 3 and lateral walls 5, which are hinged to this base frame 3 by way of hinges and can be folded down in the direction of the pallet 1. The base frame 3 may comprise four contiguous longitudinally-extending walls 3-1, 3-2, 3-3, 3-4, defining a frame perimeter corresponding to the perimeter 101 of the upper surface 100 of transport pallet 1, shown in FIG. 2.

In this figure, the lateral walls are shown in an upright position, wherein they are connected to each other in the corner regions by way of locking bars 6.

Engaging elements 8 are integrally formed on the upper edges 7 of the lateral walls 5, these elements engaging with corresponding receiving elements in the bottom side of the base frame 3, when attaching two attachment frames 2 to each other, wherein form-fit centering takes place.

Figure 2:
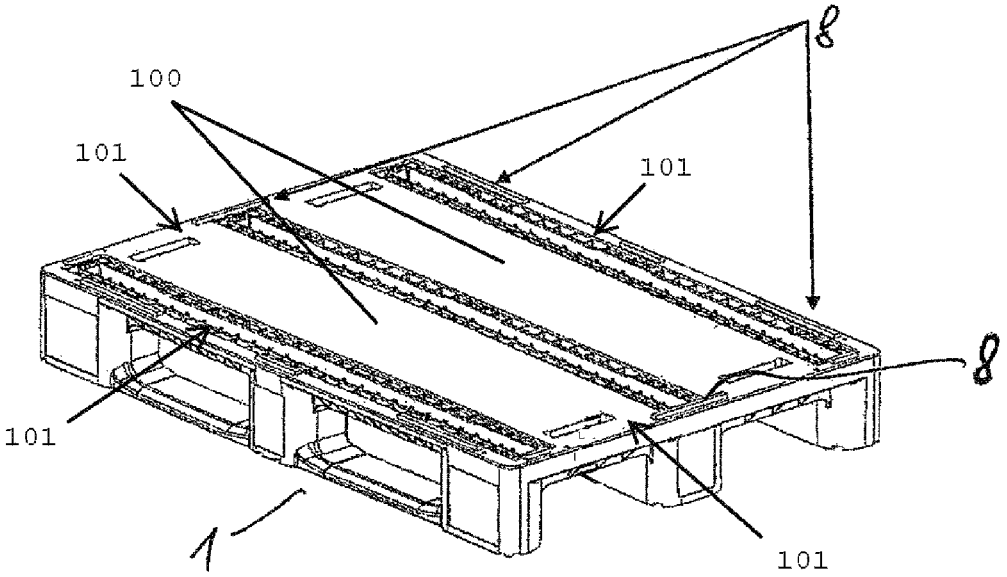
FIG. 2 shows a pallet having no attachment frame.

FIG. 2 shows a perspective illustration of the pallet 1 without the attachment frame 2 attached, so as to show the corresponding engaging elements 8 for the corresponding receiving elements in the bottom sides of the base frame 3 of the attachment frame 2.

Figure 3:
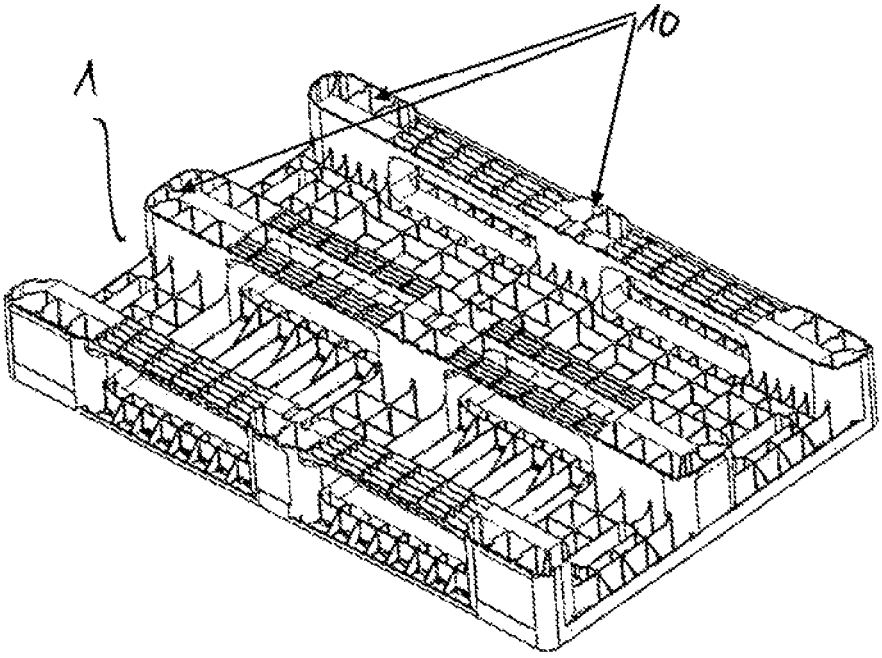
FIG. 3 is a pallet according to FIG. 2 in a view from beneath.

FIG. 3 shows the pallet 1 of FIG. 2 from beneath, from which it is apparent that openings 10 are also provided in the bottom side of the pallet 1, which are also used to attach such a pallet to an attachment frame 2.

Figure 4:
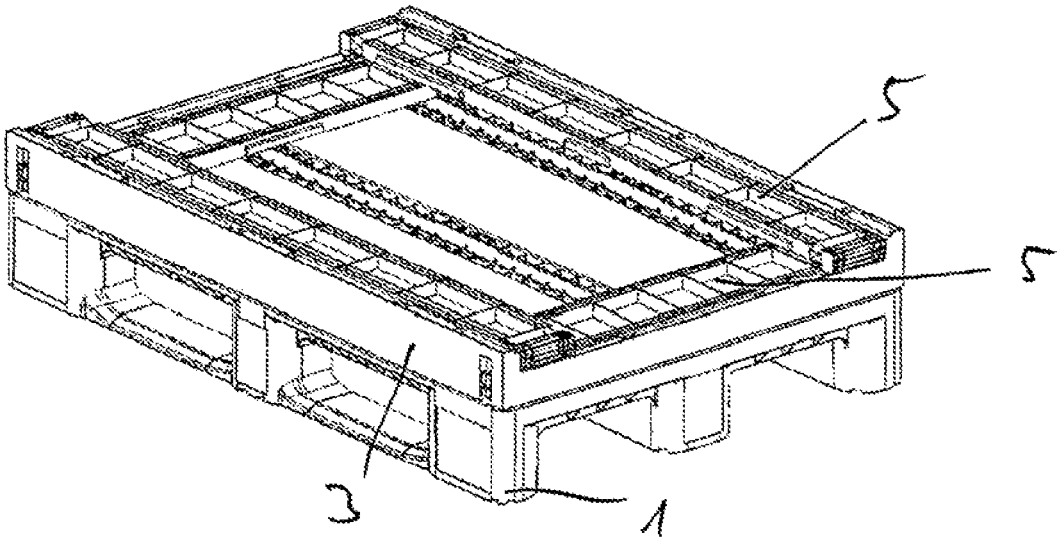
FIG. 4 shows a pallet having an attached attachment frame that is folded.

FIG. 4 shows a pallet 1 having an attached attachment frame 2, in which the lateral walls 5 are folded inward so that the shorter lateral walls are initially folded against the pallet 1, and then the longer lateral walls 5 are folded onto the previously folded-down shorter lateral walls 5.

Figure 5:
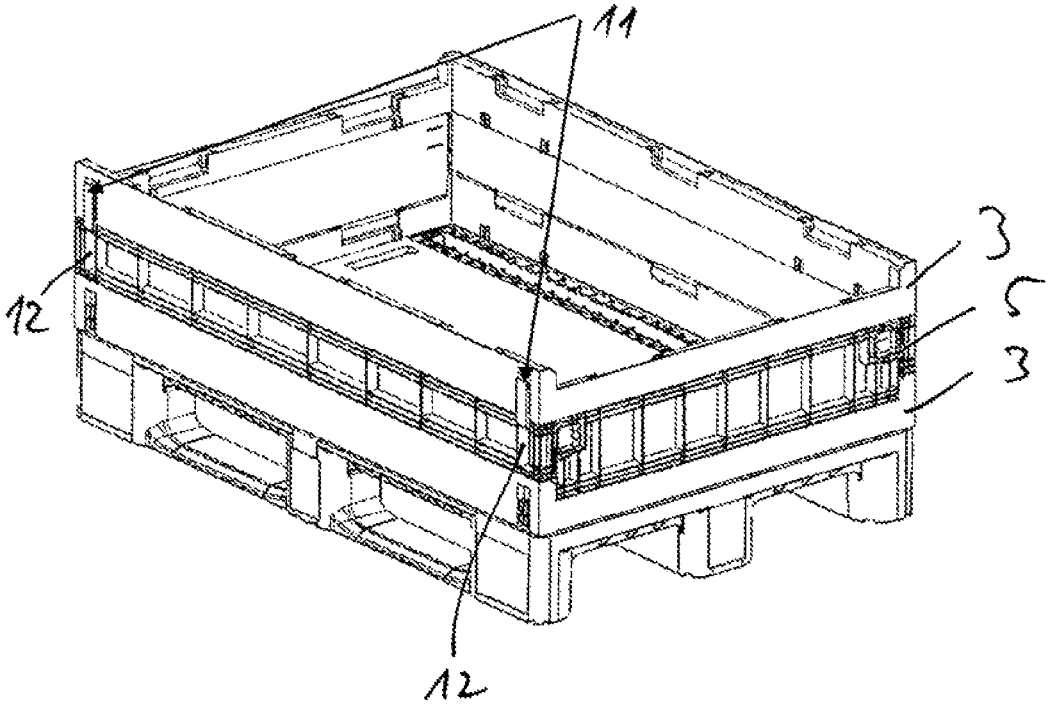
FIG. 5 shows a pallet having two attachment frames disposed on top of each other, wherein the lateral walls have been omitted in the upper attachment frame.

FIG. 5 shows a pallet 1 comprising a first attachment frame 2, wherein a further attachment frame 2 is attached to the first attachment frame 2; however, the lateral walls 5 have been omitted here.

It is apparent from this figure that the two attachment frames 2 are connected to each other by way of connecting elements 11. For this purpose, mutually aligned grooves 12 are provided both in the lateral walls 5 of the lower attachment frame 2 and in the base frame of the attachment frame 2 placed thereon, wherein, after the upper attachment frame 2 has been attached to the lower attachment frame 2, the connecting elements 11 are pushed into the grooves 12 so that a connection is created between the two attachment frames 2.

Figure 6:
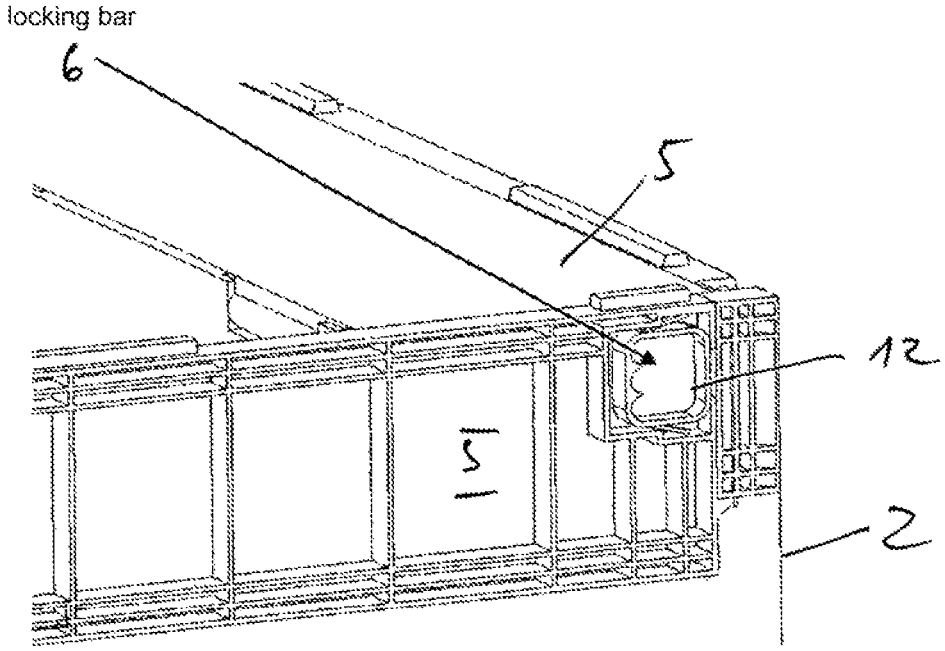
FIG. 6 shows a detail of an attachment frame having a lateral lock.

FIG. 6 shows a detail of a corner region of an attachment frame 2, wherein the mutually abutting lateral walls 5 are connected to each other with the aid of the locking bar 6, the actuating element 12 of which can be seen, by way of lateral displacement.

Figure 7:
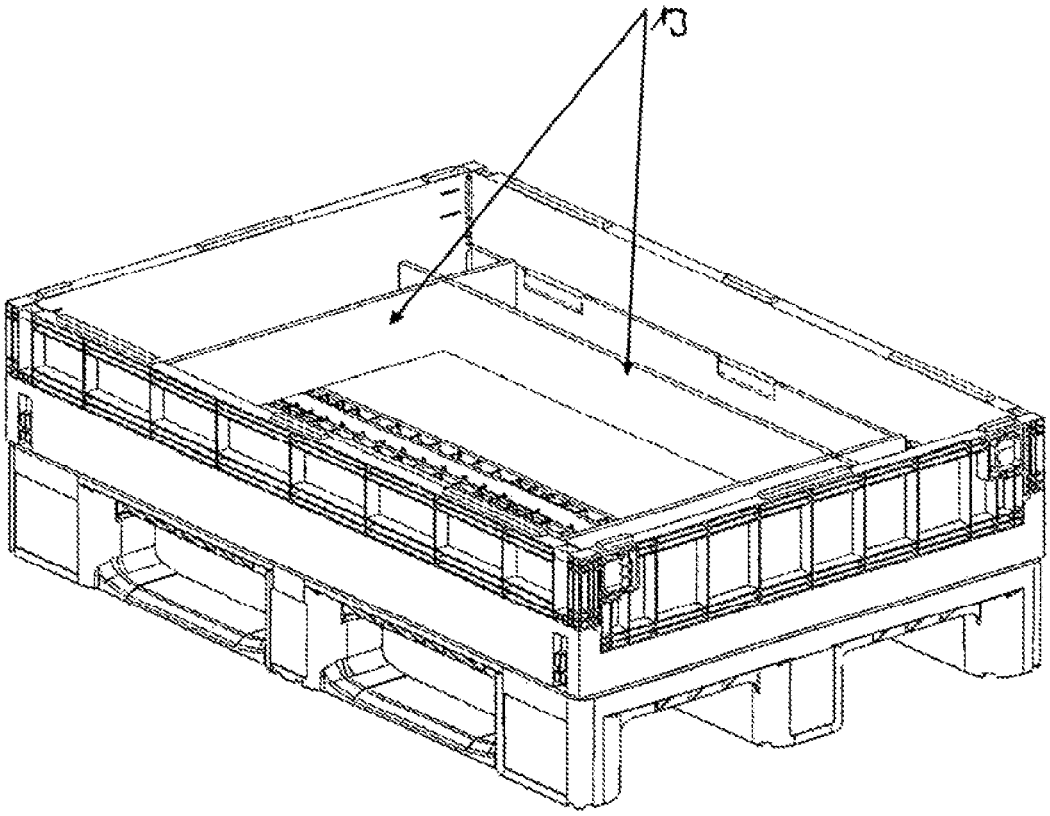
FIG. 7 shows a pallet having an attachment frame and inserted partitions.

FIG. 7 shows a pallet 1 having an attached attachment frame 2 into which partitions 13 are inserted, which divide the usable space in keeping with the load.

Figure 8:
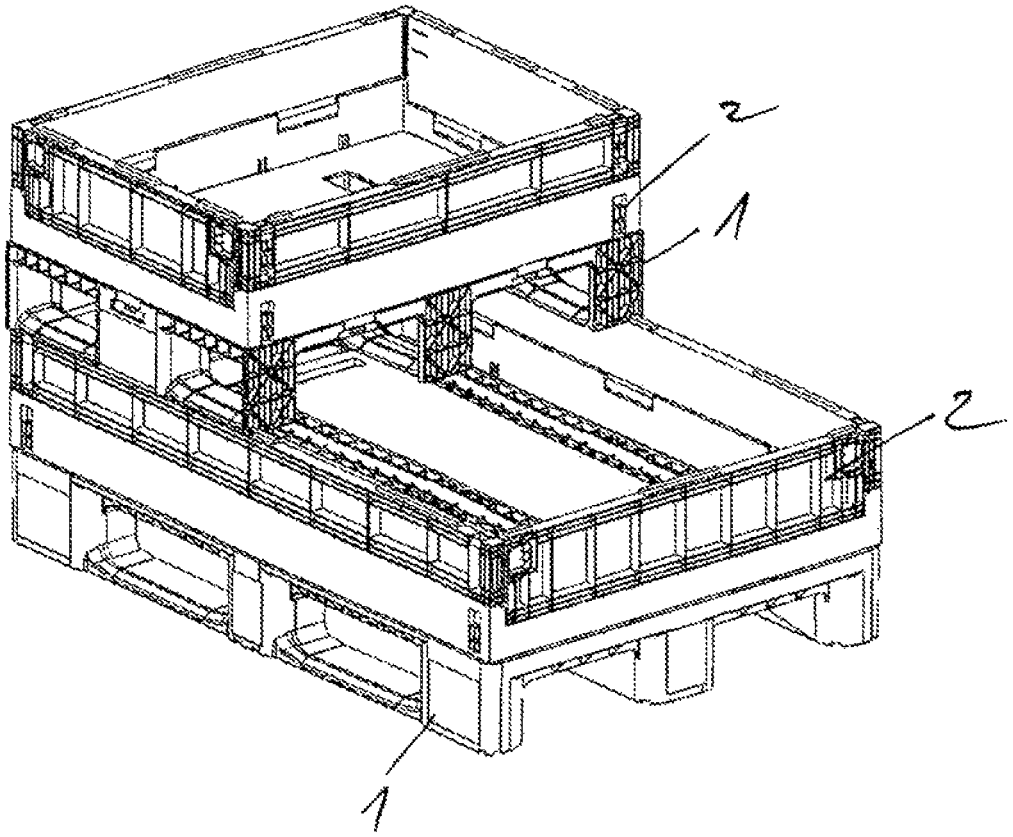
FIG. 8 shows a pallet having an attached attachment frame and an attached pallet measuring half the dimensions, with the corresponding attachment frame.

FIG. 8 shows a combined stacked configuration of attachment frames 2 and pallets 1.

Here, an attachment frame 2 taking up the entire area of the pallet 1 is attached to the pallet 1 referred to as base pallet. Attached to this attachment frame is a pallet 1 covering half the area, to which, in turn, an appropriately dimensioned attachment frame 2 is attached.

Figure 9:
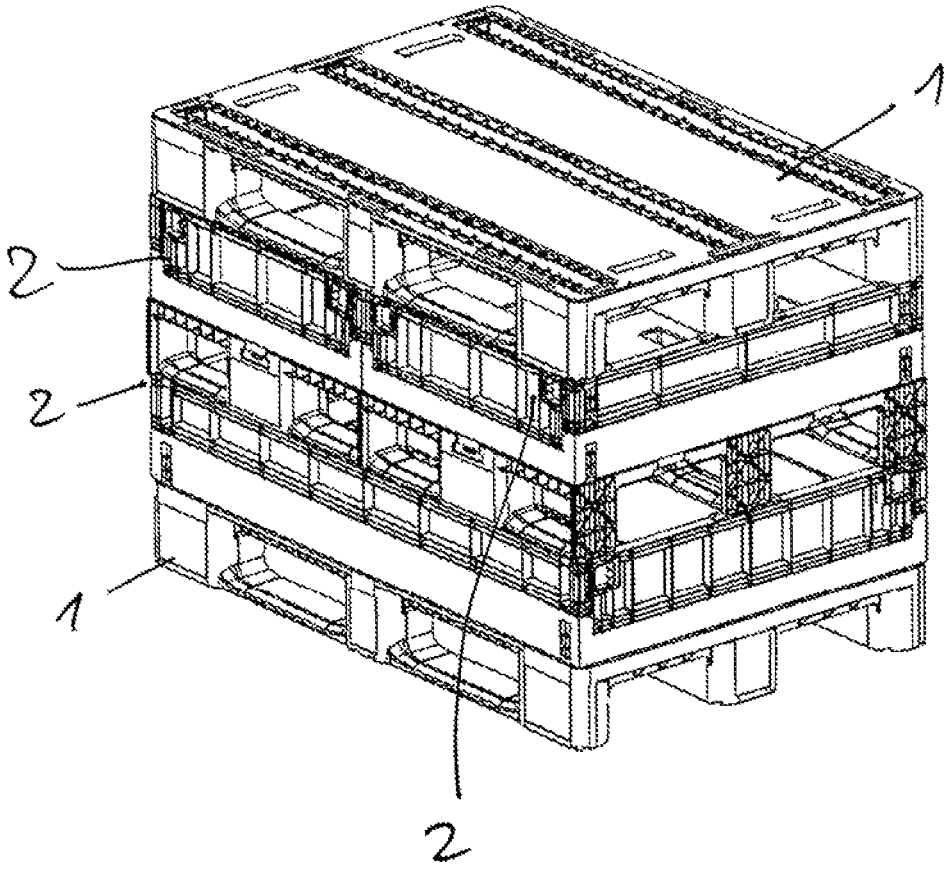
FIG. 9 shows a pallet having an attachment frame and further pallets or attachment frames in a mixed stack.

It is apparent from FIG. 9 that, in this way, a mixed stacked configuration is attained wherein, in the present exemplary embodiment, an appropriately sized base frame 2 is attached to the base pallet 1, to which two attachment frames 2, which are half the size of the area, are attached, and to which, in turn, a pallet 1 corresponding to the lower pallet 1 is attached.

The lower attachment frame 2 can be screwed onto pallet 1 by way of screws.

The invention claimed is:

1. A collapsible and stackable attachment frame system comprising first and second attachment frames each stackable upon each other and upon a transport pallet, the system comprising:

the first attachment frame comprising four contiguous longitudinally-extending walls defining a rigid perimeter frame extending vertically from a bottom to a top and defining an interior that is open at the top and the bottom and comprising first and second sets of opposing lateral walls foldably hinged thereon, the first attachment frame having a first bottom surface comprising first bottom engaging elements and a first top surface comprising first top engaging elements;

the second attachment frame comprising four contiguous longitudinally-extending walls defining a rigid perimeter frame extending vertically from a bottom to a top and defining an interior that is open at the top and the bottom and comprising first and second sets of opposing lateral walls foldably hinged thereon, the second attachment frame having a second bottom surface comprising second bottom engaging elements and a second top surface comprising second top engaging elements;

the transport pallet comprising a third top surface comprising third top engaging elements;

wherein the third top engaging elements are located, sized, and shaped to removably connect with the first bottom engaging elements when the first attachment frame is stacked upon the transport pallet;

wherein the third top engaging elements are located, sized, and shaped to removably connect with the second bottom engaging elements when the second attachment frame is stacked upon the transport pallet;

wherein the second top engaging elements are located, sized, and shaped to removably connect with the first bottom engaging elements when the first attachment frame is stacked upon the second attachment frame; and wherein the first top engaging elements are located, sized, and shaped to removably connect with the second bottom engaging elements when the second attachment frame is stacked upon the first attachment frame.

2. The collapsible and stackable attachment frame system of claim 1, wherein the first attachment frame and the second attachment frame are dimensionally interchangeable.

3. The collapsible and stackable attachment frame system of claim 2, comprising a plurality of said first attachment frames and a plurality of said second attachment frames.

4. The collapsible and stackable attachment frame system of claim 3, comprising a plurality of said transport pallets.

5. The collapsible and stackable attachment frame system of claim 4, wherein each of the transport pallets further comprises a third bottom surface comprising third bottom engaging elements located, sized, and shaped to removably connect with the first top engaging elements when one of said transport pallets is stacked upon one of the first attachment frames.

6. The collapsible and stackable attachment frame system of claim 5, wherein the third bottom engaging elements are located, sized, and shaped to removably connect with the second top engaging elements when one of said transport pallet is stacked upon one of the second attachment frames.

* * * * *